United States Patent [19]

Yamahata

[11] Patent Number: 4,689,274

[45] Date of Patent: Aug. 25, 1987

[54] MULTI-TYPE HEAT-SENSITIVE TRANSFERRING MEDIUM

[75] Inventor: Takashi Yamahata, Koriyama, Japan

[73] Assignee: General Company Limited, Osaka, Japan

[21] Appl. No.: 759,857

[22] Filed: Jul. 29, 1985

[30] Foreign Application Priority Data

Aug. 13, 1984 [JP] Japan ..... 59-167912

[51] Int. Cl.[4] ..... B41M 5/26

[52] U.S. Cl. ..... 428/522; 428/195; 428/207; 428/484; 428/488.1; 428/913; 428/914

[58] Field of Search ..... 428/195, 484, 488.1, 428/488.4, 913, 914, 207, 500, 522

[56] References Cited

FOREIGN PATENT DOCUMENTS 68253 6/1979 Japan ..... 428/195

0209190 11/1984 Japan ..... 428/914

0212297 12/1984 Japan ..... 428/914

*Primary Examiner*—Bruce H. Hess

*Attorney, Agent, or Firm*—Wegner & Bretschneider

[57] ABSTRACT

A multi-type heat-sensitive transferring medium comprises a substrate and a heat-sensitive transferring ink layer overlying the substrate and comprising a resin component, a solid component immiscible with the resin component and capable of becoming liquid by heating while solid at room temperature, and a coloring agent, the resin component being (a) a vinyl chloride-vinyl acetate copolymer having a monomer weight ratio of vinyl chloride to vinyl acetate of from 65:35 to 90:10 and having a viscosity average degree of polymerization of 200–1000, or (b) a polymethacrylic acid ester having a viscosity average degree of polymerization of 100–3000, or (c) a mixture of (a) and (b).

4 Claims, No Drawings

MULTI-TYPE HEAT-SENSITIVE TRANSFERRING MEDIUM

BACKGROUND OF THE INVENTION

1. Field of the Invention

This invention relates to a heat-sensitive transferring medium capable of being used many times (hereinafter referred to as "multi-type heat-sensitive transferring medium").

2. Description of the Prior Art

Heretofore, multi-type heat-sensitive transferring media have been known. For example, Japanese Patent Application Laid-open No. 105579/1980 discloses a heat-sensitive transferring medium comprising a base film and a layer of a porous and network structure having fine pores containing a heat melting ink which can be used repeatedly many times, and Japanese Patent Application Laid-open Nos. 89984/1981 and 36698/1982 and others disclose heat-sensitive transferring media comprising a base film and an ink layer overlying the base film and composed of dye, binder, low melting agent and fine powders, and the ink layer being consumed subsequently from the surface layer and the media being able to be used many times.

However, they are of low sensitivity and cause much smear.

SUMMARY OF THE INVENTION

An object of the present invention is to provide a multi-type heat-sensitive transferring medium free from the above-mentioned drawbacks.

Another object of the present invention is to provide a multi-type heat-sensitive transferring medium having a high sensitivity, free from smearing, and of an excellent durability.

According to the present invention, there is provided a multi-type heat-sensitive transferring medium which comprises a substrate and a heat-sensitive transferring ink layer overlying the substrate and comprising a resin component, a solid component immisicible with the resin component and capable of becoming liquid by heating while solid at room temperature, and a coloring agent, the resin component being (a) a vinyl chloride-vinyl acetate copolymer having a monomer weight ratio of vinyl chloride to vinyl acetate of from 65:35 to 90:10 and having a viscosity average degree of polymerization of 200–1000, or (b) a polymethacrylic acid ester having a viscosity average degree of polymerization of 100–3000, or (c) a mixture of (a) and (b).

DESCRIPTION OF THE PREFERRED EMBODIMENTS

The vinyl chloride-vinyl acetate copolymer has a monomer weight ratio of vinyl chloride to vinyl acetate ranging from 65:35 to 90:10, preferably, from 70:30 to 80:20 and a viscosity average degree of polymerization of 200–1000. The polymetharylic acid ester has a viscosity average degree of polymerization of 100–3000.

Outside of the above-mentioned numerical ranges, the multi-type heat-sensitive transferring medium has poor characteristics that is, low sensitivity, smearing and low durability.

As the polymethacrylic acid esters, there may be used the lower alkyl ester such as methyl ester, ethyl ester, propyl ester, butyl ester and the like.

Though it is not desired that the present invention is restricted by any mechanism, the vinyl chloride-vinyl acetate copolymers, the polymethacrylic acid esters as specified, or a mixture thereof seems to give the good results due to a good dispersability of the resin component and the heat-sensitive transferring ink, and the heat-sensitive transferring ink filling a number of continuous pores.

As the solid component immiscible with the resin component and capable of becoming liquid by heating while solid at room temperature, there may be used paraffin wax, microcrystalline wax, ceresine wax, montan wax, carunauba wax, polyethylene wax, polyethylene oxide wax, caster wax, tallow hardened oil, carbowax, Japan wax, lanorin, stearic acid, stearic acid monoglyceride, sorbitan stearate, sorbitol hexastearate, pentaerthrytol stearate, polyoxyethylene monostearate, stearyl alcohol, other synthetic oxide waxes, synthetic or natural ester waxes, hydrogenated waxes and the like, and stearic acid, stearic acid monoglyceride, and sorbitan stearate are preferable.

The weight ratio of the resin component to the solid component immiscible with the resin component and capable of becoming liquid by heating while solid at room temperature is preferably from 2:1 to 1:2.

As the coloring agents, there may be used conventional dyes, pigments, and other color-forming materials and materials capable of recording, such as alkaline basic dye, neozapon dye, Zapon dye, carbon black, Lake red, alkali blue, prussian blue, crystal violet lactone, magnetic iron oxide and the like.

As a volatile solvent for forming the heat-sensitive transferring ink, there may be used organic solvent such as toluene, ethyl acetate, methyl ethyl ketone, methanol and the like and water and the like. These solvents are selected such that the solvent can be a solvent for the resin component and can be a solvent or dispersion medium for the solid component. The solvents may be used alone or in combination.

The multi-type heat-sensitive transferring medium may be produced by preparing an ink coating material composed of the resin component, the solid component and a coloring agent dissolved and/or dispersed in a volatile solvent, applying the ink coating material to a substrate such as paper, resin film, metal sheet and the like according to a conventional method, and drying to form a heat-sensitive transferring layer adhered to the substrate.

If desired, in order to enhance the adhesion between the heat-sensitive transferring layer and the substrate, there may be formed preliminarily, on the substrate, an undercoating bonding layer composed of a resin such as polyester, vinyl chloride-vinyl acetate copolymer, acrylic resins, vinyl chloride resins and the like, or a plasticizer.

The viscosity average degree of polymerization of the vinyl chloride-vinyl acetate copolymer is measured according to JIS K 6721-1977, para. 3.1 , 3. ($\overline{P}$: mean polymerization degree). That of the polymethacrylic acid ester is measured according to the formula, $\overline{P}=[\eta]-0.0095/0.47\times10^{-4}$, where $\eta$ is a limiting viscosity number, Ichiro Sakurada: KOBUNSHI KAGAKU, Vol. 2, pp. 253–260 (1945).

The present invention, will be further explained by referring to the following examples.

EXAMPLE 1

| | |
|---|---|
| Vinyl chloride-vinyl acetate copolymer | 10 parts by weight |

-continued

| | | |
|---|---|---|
| (Viscosity average degree of polymerization: about 400) | | |
| Stearic acid | 13 | parts by weight |
| Nigrosine | 3 | parts by weight |
| Carbon black | 3 | parts by weight |
| toluene | 26 | parts by weight |
| Ethyl acetate | 45 | parts by weight |
| Total | 100 | parts by weight |

Stearic acid, nigrosine, and carbon black were mixed at 80° C. and dispersed in a solution of vinyl chloride-vinyl acetate copolymer in toluene and ethyl acetate. The resulting coating material was applied to a polyester film of 3 microns thick subjected to a sticK-preventing treatment (forming a stick-preventing layer of about 0.2 g/m$^2$ by applying a 3% aqueous solution of a mixture of potassium di(polyoxyethylene) lauryl ether phosphate and dipotassium mono (polyoxyethylene) lauryl ether phosphate) to produce a heat-sensitive transferring layer. The coating material was applied to the surface of the polyester film to which the stick-preventing treatment had not been applied.

The multi-type heat-sensitive transferring medium was tested by printing at the same portion 30 times using P6 printer (tradename, manufactured by Fuji Xerox Co.).

The test was carried out by changing variously the weight ratio of vinyl chloride to vinyl acetate. The results of Examples 1-1 to 1-8 are shown in the following Table 1.

TABLE 1

| | Vinylchloride-vinyl acetate copolymer | | | | | |
|---|---|---|---|---|---|---|
| | Vinyl chloride (%) | Vinyl acetate (%) | Sensitivity*1 Density*2 | Sensitivity*1 Resolution*3 | Smearing*4 | Durability*5 |
| 1-1 | 100 | 0 | 0.71 | Δ | 0.31 | X |
| 1-2 | 95 | 5 | 0.82 | | 0.17 | Δ |
| 1-3 | 90 | 10 | 0.98 | | 0.15 | |
| 1-4 | 80 | 20 | 1.15 | | 0.12 | |
| 1-5 | 70 | 30 | 1.13 | | 0.11 | |
| 1-6 | 65 | 35 | 0.99 | | 0.17 | |
| 1-7 | 60 | 40 | 0.81 | | 0.29 | Δ |
| 1-8 | 50 | 50 | 0.69 | Δ | 0.27 | X |

*1Sensitivity is defined as a state of the resulting printing at a low energy, that is, when the heat generated by the thermal head is small. When the state of the resulting printing is good, the sensitivity is regarded as good. The state of the resulting printing is evaluated on the basis of both density and resolution of the printed image. When the printed image is excellent in both density and resolution, said state of the resulting printing is regarded as excellent.

*2Density is determined by using MACBETH RD-514 densitometer (tradename, manufactured by Koll Morgen Co.) (averaged value of 30 measurements).

*3Resultion is evaluated by eye-observation and classified into four degrees, from excellent to poor, by the following signs: , , Δ, X.

*4Smearing is determined by measuring the smearing around the printed image produced by reciprocating rubbing for 3 minutes at a speed of 43 times per minute under a load of 908 g (2 lb.) by means of Rub Tester produced by YASUDA SEIKI SEISAKUSHO K.K.

*5Printed image density of the first printing is compared with that of the 30th printing. The following four degrees are used to show the result:

| | |
|---|---|
| Density change within 10% of density of the first printing | |
| Density change within 20% of density of the first printing | |

TABLE 1-continued

| | |
|---|---|
| Density change within 30% of density of the first printing | Δ |
| Density change over 30% of density of the first printing | X |

As is clear from Table 1 above, where the weight ratio of vinyl chloride to vinyl acetate of the vinyl chloride-vinyl acetate copolymer is within the range of from 65:35 to 90:10, good results are obtained. Where the weight ratio is from 70:30 to 80:20, particularly good results are obtained.

Table 2 below shows the results of the procedure similar to the above-mentioned one except that the viscosity average degree of polymerization was varied (the weight ratio of vinyl chloride and vinyl acetate being 75:25).

TABLE 2

| | Viscosity average degree of polymerization of vinyl chloride-vinyl acetate copolymer | Sensitivity*1 Density*2 | Sensitivity*1 Resolution*3 | Smearing*4 | Durability*5 |
|---|---|---|---|---|---|
| 1-9 | 100 | 0.92 | Δ | 0.19 | Δ |
| 1-10 | 200 | 1.14 | | 0.11 | |
| 1-11 | 400 | 1.15 | | 0.12 | |
| 1-12 | 1000 | 1.18 | | 0.13 | |
| 1-13 | 1500 | 0.80 | Δ | 0.18 | Δ |
| 1-14 | 2000 | 0.76 | Δ | 0.17 | Δ |

*1–*5are the same as those as mentioned above.

As is clear from Table 2 above, where the viscosity average degree of polymerization of the vinyl chloride-vinyl acetate copolymer ranges from 200 to 1000, there is obtained a good result.

EXAMPLE 2

| | | |
|---|---|---|
| Poly (ethyl methacrylate) | 8 | parts by weight |
| Sorbitan stearate | 16 | parts by weight |
| Carbon black | 5 | parts by weight |
| Toluene | 25 | parts by weight |
| Ethyl acetate | 46 | parts by weight |
| Total | 100 | parts by weight |

Sorbitan stearate and carbon black were mixed and dispersed in a solution of poly (ethyl methacrylate) in toluene and ethyl acetate, and the resulting mixture was used to form a heat-sensitive transferring layer following the procedures in Example 1. The resulting multi-type heat-sensitive transferring medium was tested by printing at the same portion 30 times by using P6 printer (tradename, manufactured by Fuji Xerox Co.).

Viscosity average degree of polymerization of poly (ethyl methacrylate) was changed variously to carry out the procedures of Example 2-1 to Example 2-6. The results are shown in Table 3 below.

TABLE 3

| | Viscoity average degree of polymerization of poly lethyl methacrylate) | Sensitivity*1 Density*2 | Sensitivity*1 Resolution*3 | Smearing*4 | Durability*5 |
|---|---|---|---|---|---|
| 2-1 | 50 | 0.89 | Δ | 0.18 | Δ |
| 2-2 | 100 | 1.12 | | 0.12 | |
| 2-3 | 2000 | 1.15 | | 0.13 | |
| 2-4 | 3000 | 1.14 | | 0.12 | |
| 2-5 | 3500 | 0.98 | | 0.15 | |

TABLE 3-continued

| | Viscoity average degree of polymerization of poly lethyl methacrylate) | Sensitivity*1 | | | |
|---|---|---|---|---|---|
| | | Density*2 | Resolution*3 | Smearing*4 | Durability*5 |
| 2-6 | 5000 | 0.72 | Δ | 0.17 | Δ |

*1-*5 are as defined in Table 1.

As is clear from Table 3, when the viscosity average degree of polymerization of the polymethacrylate is within the range of 100-3000, there is obtained a good result.

EXAMPLE 3

| | |
|---|---|
| Vinyl chloride-vinyl acetate copolymer (weight ratio of vinyl chloride to vinyl acetate, 80:20; viscosity average degree of polymerization, 500) | 10 parts by weight |
| Poly (methyl methacrylate) (Viscosity average degree of polymerization: 2000) | 6 parts by weight |
| Stearic acid monoglyceride | 8 parts by weight |
| Neozapon Firely Red | 1 parts by weight |
| Lake red | 4 parts by weight |
| Toluene | 26 parts by weight |
| Ethyl acetate | 45 parts by weight |
| Total | 100 parts by weight |

Repeating the procedure of Example 1 by using the above-mentioned ingredients, there was produced a multi-type heat-sensitive transferring medium. When the same portion of the medium was used 30 times to print, the 30th printed image had the same density as that of the initial printed image and was sharp and little smearing.

EXAMPLE 4

To the surface of a polyester film of 3 microns thick where a stick-preventing treatment was not effected, as used in Example 1, was applied a solution produced by adding 6 parts by weight of a plasticizer (DOP) to a solution of 30 parts by weight of a vinyl chloride-vinyl acetate copolymer in 20 parts by weight of toluene and 44 parts by weight of ethyl acetate, followed by drying to form an undercoating bonding layer of 2 microns thick. A coating material as used in Example 3 was applied to the undercoating bonding layer to form a heat-sensitive transferring layer.

The resulting multi-type heat-sensitive transferring medium was tested in a way similar to Example 1. The test revealed that the durability was higher than that of Example 3.

What is claimed is:

1. A multi-type heat-sensitive transferring medium which comprises a substrate and a heat-sensitive transferring ink layer overlying the substrate and comprising a resin component, a solid component immiscible with the resin component and capable of becoming liquid by heating while solid at room temperature, and a coloring agent, the resin component being (a) a vinyl chloride-vinyl acetate copolymer having a monomer weight ratio of vinyl chloride to vinyl acetate of from 65:35 to 90:10 and having a viscosity average degree of polymerization of 200-1000, or (b) a polymethacrylic acid ester having a viscosity average degree of polymerization of 100-3000, or (c) a mixture of (a) and (b).

2. A multi-type heat-sensitive transferring medium according to claim 1 in which the weight ratio of the resin component to the solid component immiscible with the resin component and capable of becoming liquid by heating while solid at room temperature ranges from 2:1 to 1:2.

3. A multi-type heat-sensitive transferring medium according to claim 1 in which the substrate has an undercoating bonding layer.

4. A multi-type heat-sensitive transferring medium according to claim 1 in which the monomer weight ratio of vinyl chloride to vinyl acetate ranges from 70:30 to 80:20.

* * * * *

UNITED STATES PATENT AND TRADEMARK OFFICE

CERTIFICATE OF CORRECTION

PATENT NO. : 4,689,274

DATED : August 25, 1987

INVENTOR(S) : Takashi Yamahata

It is certified that error appears in the above-identified patent and that said Letters Patent is hereby corrected as shown below:

IN THE CLAIMS

Claim 1, last line, delete ", or (c) a mixture of (a) and (b)".

Signed and Sealed this

Twenty-seventh Day of September, 1988

*Attest:*

DONALD J. QUIGG

*Attesting Officer*

*Commissioner of Patents and Trademarks*